United States Patent [19]

Stavropoulos

[11] Patent Number: 4,983,272

[45] Date of Patent: Jan. 8, 1991

[54] PROCESS FOR DELAYED COKING OF COKING FEEDSTOCKS

[75] Inventor: Napoleon Stavropoulos, Fort Lee, N.J.

[73] Assignee: Lummus Crest, Inc., Bloomfield, N.J.

[21] Appl. No.: 274,401

[22] Filed: Nov. 21, 1988

[51] Int. Cl.[5] ..... C10B 55/00

[52] U.S. Cl. ..... 208/50; 208/80; 208/131

[58] Field of Search ..... 208/131, 80, 50

[56] References Cited

U.S. PATENT DOCUMENTS

| | | | |
|---|---|---|---|
| 2,626,892 | 1/1953 | McCulley et al. | 208/131 |
| 3,617,515 | 11/1971 | Bloomer | 208/131 |
| 3,956,101 | 5/1976 | Hara et al. | 208/131 X |
| 4,501,654 | 2/1985 | Allan | 208/131 X |
| 4,518,486 | 5/1985 | Jansma | 208/131 |

*Primary Examiner*—Patrick P. Garvin
*Assistant Examiner*—E. D. Irzinski
*Attorney, Agent, or Firm*—Elliot M. Olstein; Raymond J. Lillie

[57] ABSTRACT

A process for producing coke from a combined feed. The combined feed is initially provided as a first portion which comprises easily cokable components and a second portion which is essentially free of easily cokable components. The first portion is heated to a temperature lower than that normally employed by a coking heater in a delayed coking process. The second portion is heated to a temperature at which a combination of the first and second portion provides combined feed at coking temperatures. The combined feed is then subjected to coking conditions.

The first portion, in one embodiment, may be comprised of a fresh feed and the second portion may be comprised of a coker recycle. In another alternative, a fresh feed and a coker recycle are combined and fractionated to produce the first portion and the second portion. The first portion may include components which boil above a temperature of about 900° F., and the second portion may be essentially free of easily cokable components.

11 Claims, 3 Drawing Sheets

PROCESS FOR DELAYED COKING OF COKING FEEDSTOCKS

This invention relates to improvements in the delayed coking of a coking feedstock. More particularly, this invention relates to an improvement in heating a feedstock to a coke drum, said feedstock comprising a fresh stream and a recycle stream.

In an embodiment of a delayed coking process, a fresh, or uncoked, feedstock is combined with a recycle stream, prior to the introduction of the fresh feedstock and the recycle stream to a coking heater. Examples of such an embodiment are disclosed in U.S. Pat. Nos. 4,216,074, issued to Simone, and 4,326,853, issued to Sze, et al, In U.S. Pat. No. 4,216,074, coal is liquefied in the presence of a liquefaction solvent. An ash-containing liquefaction product is separated from an ash-free product. The ash-containing fraction is combined with the bottoms of a coker combination tower prior to introduction of the ash-containing fraction to a coker heater, which heats the ash-containing fraction to coking temperatures so as to produce ashy coke. Coke drum vapors from the production of the ashy coke are recycled to the combination tower. A bottoms fraction withdrawn from the combination tower is then passed to the ash-containing fraction as described above as recycle.

In U.S. Pat. No. 4,326,853, both the ash-containing fraction and the ash-free fraction, obtained as a result of ash separation from a coal liquefaction product, are combined with separate recycle streams obtained from bottoms fractions of a coker combination tower, prior to the introduction of each fraction into separate coking heaters, which heat each fraction to coking temperatures in separate coke drums. Vapors from each coke drum are sent to separate stages of a combination toWer. A bottoms fraction is then withdrawn from each respective stage of the combination tower and then admixed with the respective ash-free or ash-containing fraction.

Applicant has found that although such combined streams, depending on the feeds employed, may be suitable for the production of quality coke, the combined stream may tend to deposit coke in the coking heater coil as the stream is passing through the coking heater. The coke deposits are in most instances derived from high-boiling materials in the fresh, or uncoked, feed. The coke build-up restricts the flow of the feed to the coking heater and eventually necessitates shutdown of the coking apparatus for the cleaning of coke from or replacement of the coking heater.

In accordance with an aspect of the present invention, there is provided a process for producing coke from a combined feed which comprises initially providing the combined feed as a first portion which contains easily cokable components and as a second portion which is essentially free of easily cokable components. The first portion is then heated to temperatures lower than those normally employed in a coking heater in a delayed coking process. In general, such temperatures do not exceed 900° F., and preferably do not exceed 850° F. The second portion is heated to a temperature at which a combination of the first and second portions provides a combined feed which is at coking temperatures. The combined feed is then coked at coking conditions. In one embodiment, the first portion is comprised of a fresh feed and the second portion is comprised of recycle from the coke drum.

In one embodiment in accordance with the present invention, a fresh feed and a coker recycle are combined and fractionated to produce the first portion and second portion.

In a preferred embodiment, the first portion includes easily cokable components which are those which boil above a temperature of about 900° F., preferably those which boil above about 1,000° F., whereas the second portion is essentially free of such easily cokable components. The selection of such components which are preferably excluded from the second portion is within the skill of the art from the teachings herein.

In a most preferred embodiment, the first portion, which contains easily cokable components, is heated to a temperature which is lower than typical coking temperatures. The second portion, which is essentially free of easily cokable components, is heated to a temperature such that, when the second portion is combined with the first portion to form the combined feed, the combined feed will attain coking temperatures as a result of an exchange of heat between the first portion and the second portion. Applicant has found therefore, that, in accordance with this preferred embodiment, that by heating the first portion, which contains easily cokable components, to a temperature which is less than typical coking temperatures, and by heating the second portion, which is essentially free of easily cokable components, to a temperature such that when the first portion and the second portion are combined, the combined feed will be at coking temperatures, the combined feed attains coking temperatures without the formation of coke deposits within the coils of the coking heater. The first and second portions may be combined in a feed line to the coke drum or within the coke drum.

A fresh feed, before being passed to a coker heater, may have been treated by various means which are well known in the art, depending on the type of feedstock employed. The feed, for example may be treated by soaking the feed in sulfur. The feed is usually soaked in the presence of at least 30 parts per million of sulfur and no greater than 200 parts per million of sulfur. The soaking is generally effected for at least 5 minutes to 120 minutes, and at a temperature of from 230° C. to 315° C. It is believed that the soaking step improves the overall operation by polymerizing polymerizable components.

Subsequent to the sulfur soaking, the fresh petroleum feed may be subjected to thermal cracking. Typical cracking conditions are at an outlet temperature of from about 450° C. to 595° C., and at a pressure of from 4 to 50 kg/cm$^2$G. The cracking of the feed increases the aromaticity and reduces the API gravity of the feed. After the feed is thermally cracked, it may be flashed so as to remove naphtha and lighter gases. Flashing may take place at a temperature of from 380° C. to 510° C., and at a pressure of from 0.1 kg cm$^2$/G to 2.0 kg cm$^2$/G. Subsequent to flashing, the feed may then be fractionated in a coker combination tower, whereby products such as heavy coker gas oil, light coker gas oil, and coker naphtha may be removed. The bottoms from such a combination tower may then be passed to a coker heater to prepare the feedstock for coking. The bottoms may be heated in the coker heater so as to provide coke drum temperatures of from 415° C. to 455° C. Such a method of processing a coking feed is disclosed, for example, in U.S. Pat. No. 4,547,284, issued to Sze. et al.

Typical feeds which are generally employed in the process disclosed in the Sze patent are heavy feedstocks, such as a distillation residue derived from a crude oil, lube oil extract and hydrodesulfurized lube extract, a cracking residue or a hydrodesulfurized product of a residue from the distillation or cracking of petroleum. Preferred feedstocks are the so-called pyrolysis fuel oils or black oils which are the residual heavy black oils boiling above pyrolysis gasoline; i.e., boiling above 187° C. to 218° C. which are produced together with olefins in the pyrolysis of liquid hydrocarbon feeds, catalytic cracker decant oils, thermally cracked tar, lube oil extract and its hydrodesulfurization product, coal tar or pitch and the like.

In the Sze patent, coker recycle in the form of overhead vapors withdrawn from the coke drum are passed to the combination tower. The coke drum vapors then become admixed with the fresh feed in the combination tower. The bottoms fraction, therefore, is derived from a coke drum vapor stream and a fresh feed. Applicant has found that the feeding of the bottoms fraction from a combination tower to a coker heater, may, over a period of time, result in the formation of coke deposits in the coker heater.

Applicant has overcome this problem of the formation of coke deposits in the coke heater by, in one embodiment, fractionating the combination of coker recycle and fresh feed into a first portion which contains easily cokable materials and a second portion essentially free of easily cokable materials. As described above, the first portion is heated to temperatures lower than those normally employed by a coking heater in a delayed coking process, preferably not exceeding 900° F., most preferably not exceeding 850° F., and the second portion is heated to a temperature at which a combination of the first portion and the second portion provides a combined feed at coking temperatures.

In an alternative embodiment, the coking vapors may be separated into a heavy fraction and a light fraction. The light fraction is combined with a fresh feed and fractionated to obtain the first portion, which is heated to temperatures lower than those normally employed by a coking heater in a delayed coking process, preferably not exceeding 900° F., most preferably not exceeding 850° F. The heavy fraction recovered from the coke drum vapors, in this embodiment forms the second portion of the combined feed. In this embodiment, both the light and heavy fractions recovered from the coke drum vapors are essentially free of easily cokable components. Alternatively, the light fraction may be directly recovered and not combined with the fresh feed for fractionation.

In some instances, a fresh feed or a portion of a fresh feed may not be sent to a combination tower prior to being heated in a coker heater. A combination tower may, however, be used to fractionate coker recycle in the form of overhead vapors from the coke drum. In such a case, the fresh feed which is the first portion of the combined feed, is heated to temperatures lower than those normally employed by a coking heater in a delayed coking process. As described above, such temperatures generally do not exceed 900° F., and most preferably do not exceed 850° F. The bottoms from the combination tower which is a coker recycle is the second portion of the combined feed and is heated to a temperature at which the combination of the first and second portions provides a combined stream at coking temperatures. Examples of such fresh feeds include coal liquefaction products which comprise coal dissolved in a liquefaction solvent, although the scope of the invention is not to be limited to such feeds.

The invention will now be described with respect to the drawings wherein.

Figure 1:
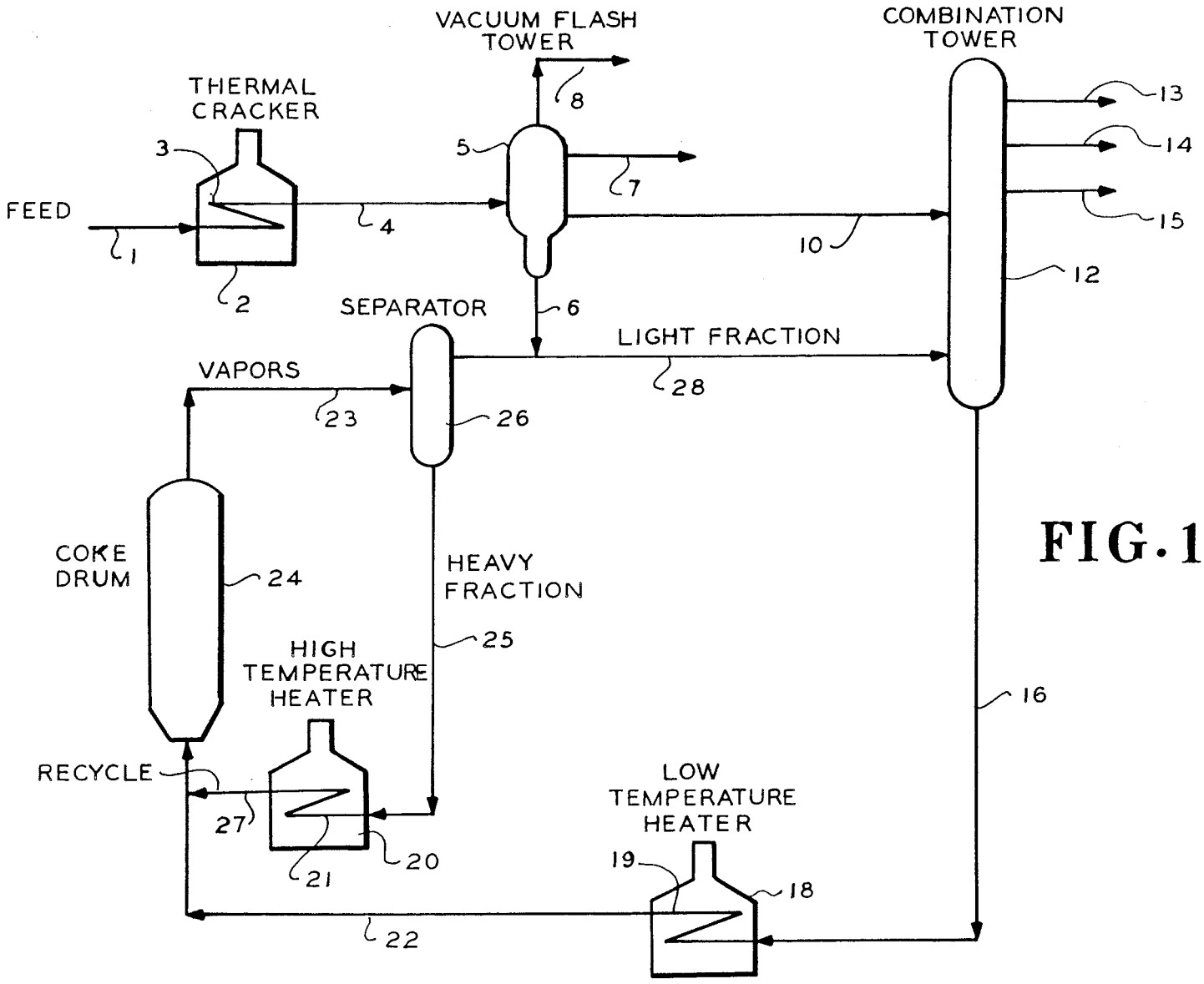
FIG. 1 is a schematic of a first embodiment of a delayed coking process in accordance with the present invention.

As shown in FIG. 1, a feedstock in line 1 is passed through heating coil 3 of thermal cracker 2. Thermal cracking conditions may be as hereinabove described. Prior to the introduction of the feed into thermal cracker 2, the feed may undergo pretreatment by various means known in the art. One example of a pretreatment of a feedstock is to soak the feedstock in sulfur as described above.

The thermally cracked feedstock is then withdrawn from thermal cracker 2 through line 4 and passed to vacuum flash tower 5. Flashing conditions in the flash tower 5 may be at a temperature of from about 380° C. to about 510° C., and at a pressure of from about 4 $kg/cm^2G$ to about 50 $kg/cm^2G$.

A heavy pitch-like bottoms may be withdrawn from flash tower 5 through line 6, a light gas oil may be recovered through line 7, and naphtha and lighter gases may be removed through line 8. A preconditioned coking feedstock is then withdrawn from flash tower 5 through line 10 and passed to coker combination tower 12.

In the coker combination tower 12, the feedstock is fractionated into products which will not be subjected to the coking process, and into a bottoms fraction which is withdrawn through line 16. Products which will not be subjected to coking are then recovered from combination tower 12. Coker naphtha and gases are recovered through line 13, a light coker gas oil is recovered through line 14, and a heavy coker gas oil is recovered through line 15. Alternatively, all or a portion of the heavy coker gas oil may be withdrawn through line 16 as part of the bottoms fraction. The coker combination tower 12 is operated as is known in the art. Specific operating conditions depend upon the feedstock employed.

The bottoms fraction in line 16 is passed to coil 19 of coker heater 18. In order to prevent the formation of coke deposits within coil 19, coker heater 18 heats the bottoms fraction to temperatures lower than those normally employed by a coking heater in a delayed coking process. Such temperatures generally do not exceed 900° F., and preferably do not exceed 850° F.

The bottoms fraction, after being heated in coker heater 18, is then passed to line 22. A coker recycle stream from line 27 enters line 22 to combine with the heated bottoms fraction. The recycle stream has been heated to a temperature at which, when the recycle stream is introduced into line 22, there is provided a combined stream at coking temperatures. The entry of recycle stream into line 22 serves to heat the bottoms fraction from the combination tower 12, said bottoms fraction being a fresh, uncoked feed, to a desired coking temperature. The combined stream of the bottoms fraction and the recycle stream is then passed to coke drum 24.

Coke drum 24 is operated at a temperature of from about 415° C. to about 510° C., preferably from about 430° C. to about 475° C., and at a pressure of from about 2 kg/cm$^2$G to about 10 kg/cm$^2$G, preferably from about 3 kg/cm$^2$G to about 6 kg/cm$^2$G. The combined stream is thus converted into coke, with overhead vapors being withdrawn from coke drum 24 through line 23.

The vapors withdrawn through line 23 are passed to separator 26. The vapors may be comprised mainly of refractory materials which do not tend to form coke deposits if reheated. Separator 26 serves to separate the vapors into a light fraction and a heavy fraction. The light fraction, comprised of materials boiling below a temperature in the range of from about 500° F. to about 650° F., is withdrawn through line 28 and passed to coker combination tower 12, whereby the light fraction may be introduced into combination tower 12 to recover various fractions therefrom.

Alternatively, the light fraction may be recovered directly and not passed to combination tower 12.

The heavy fraction, which is comprised of materials boiling above a temperature in the range of from about 500° F. to about 650° F., is withdrawn from separator 26 through line 25 and passed to coil 21 of coker heater 20. The temperature of operation of coker heater 20 depends mainly on the temperature of operation of coker heater 18, and the volume of heavy fraction being heated in that one wishes to provide a combined feed of the heavy fraction and the bottoms fraction from combination tower 12 at coking temperatures. The heavy fraction, upon being heated in coker heater 20, is withdrawn as a coker recycle stream through line 27, and combined with the bottoms fraction in line 22 to form a combined stream of the bottoms fraction, comprised of a fresh, uncoked feedstock, and a recycle stream in line 22. Upon contact of the recycle stream with the bottoms fraction in line 22, the recycle stream serves to heat the bottoms fraction to a desired coking temperature through a heat exchange between the bottoms fraction and the recycle stream. The heating of the bottoms fraction to a desired coking temperature is thereby completed in line 22 as opposed to coker heater 18. The combined stream is then fed to coke drum 24. In this way, deposits of coke in coil 19 of heater 18 is therefore prevented.

Alternatively, the fresh feedstock in line 22 and the recycle stream in line 27 may be fed separately to coke drum 24, thereby being admixed in the coke drum 24, said mixture attaining a desired coking temperature in coke drum 24.

Figure 2:
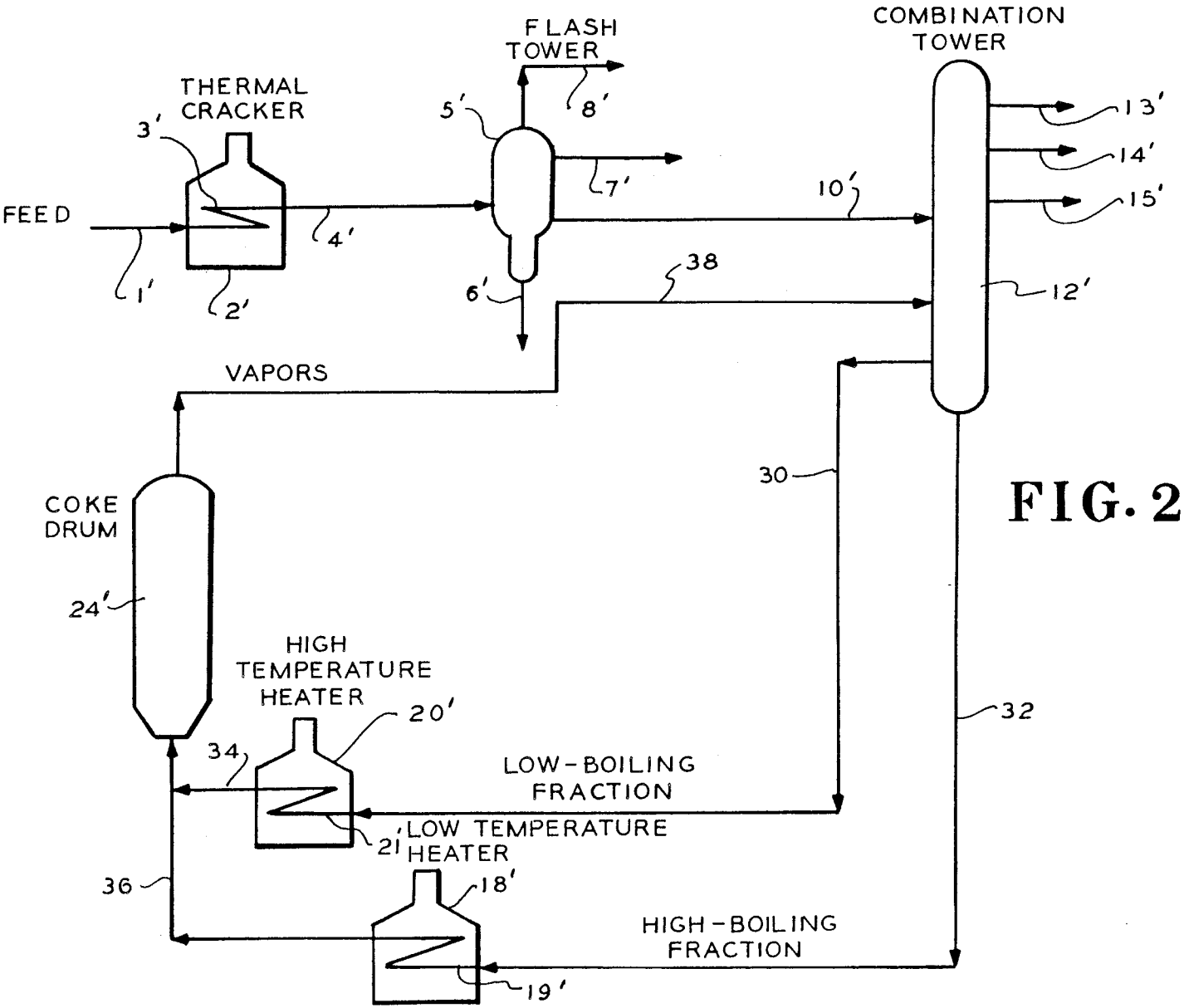
FIG. 2 is a schematic of second embodiment of a delayed coking process in accordance with the present invention.

Referring now to FIG. 2, which depicts a second embodiment in accordance with the present invention, a feed is introduced through line 1' into coil 3' of thermal cracker 2'. Prior to the introduction of the feed into thermal cracker 2', the feed may be pretreated, such as by soaking the feed in sulfur, as described above. Thermal cracker 2' is operated as hereinabove described. The cracked feedstock is then withdrawn from thermal cracker 2' through line 4' and passed to flash tower 5'. Flash tower 5' is operated as hereinabove described.

A heavy pitch-like bottoms may be recovered through line 6', a light gas oil may be recovered through line 7', and naphtha and lighter gases may be recovered through line 8'. A preconditioned coking feedstock is withdrawn through line 10' and passed to combination tower 12'. Vapors from coke drum 24' may also be introduced into combination tower 12' through line 38. In coker combination tower 12', the fresh feed and coking vapors are fractionated into a first portion, or high-boiling fraction, containing easily cokable components, and a second portion, or low-boiling fraction, which is essentially free of easily cokable components. Coker naphtha and gas oils are also recovered, Coker naphtha and gases are recovered through line 13', a light coker gas oil is recovered through line 14', and a heavy coker gas oil is recovered through line 15', Alternatively, all or a portion of the heavy coker gas oil may be sent for further processing.

A first fraction, which includes easily cokable components having boiling points above 900° F., preferably above 1,000° F., is withdrawn from combination tower 12' through line 32, and a second fraction, which is essentially free of easily cokable components, is withdrawn from combination tower 12' through line 30.

The first fraction is passed through line 32 and introduced into coil 19' of coker heater 18'. Coker heater 18' is operated at temperatures lower than those normally employed by a coking heater in a delayed coking process, preferably no greater than 900° F., most preferably no greater than 850° F. This heating prevents the formation of coke deposits within coil 19' of coker heater 18'. After being heated within coker heater 18', the first fraction is withdrawn through line 36.

The second fraction is passed through line 30 to coil 21' of coker heater 20'. The second fraction, above, is heated such that, when admixed with the heated first fraction, a combined feed at coking temperatures will be formed. After the second fraction is heated in coker heater 20', it is withdrawn through line 34, and is passed to line 36, whereby the heated second fraction will be admixed with the first fraction to form a combined feed at coking temperature.

As the first fraction is being passed through line 36, the heated second fraction is introduced into line 36 from line 34, whereby the first and second fractions become admixed with each other. A heat exchange results between the fractions and the high-boiling fraction, whereby the mixture of the low-boiling fraction and the high-boiling fraction attains coking temperatures. Preferred coking temperatures are from about 780° F. to about 950° F. The mixture of the first and second fractions is then passed through line 36 and introduced into coke drum 24'.

As an alternative, the first fraction in line 36 and the second fraction in line 34 may be introduced separately into coke drum 24', whereby the fractions are combined within coke drum 24' to form a mixture at coking temperatures.

In coke drum 24', coking of the mixture takes place at a temperature of from about 415° C. to about 510° C., and at a pressure of from about 2 kg/cm$^2$G to about 10 kg/cm G. Vapors are withdrawn from coke drum 24' through line 38. The vapors are passed through line 38 and introduced into combination tower 12', wherein the vapors may be mixed with the fresh feedstock introduced through line 10'.

Figure 3:
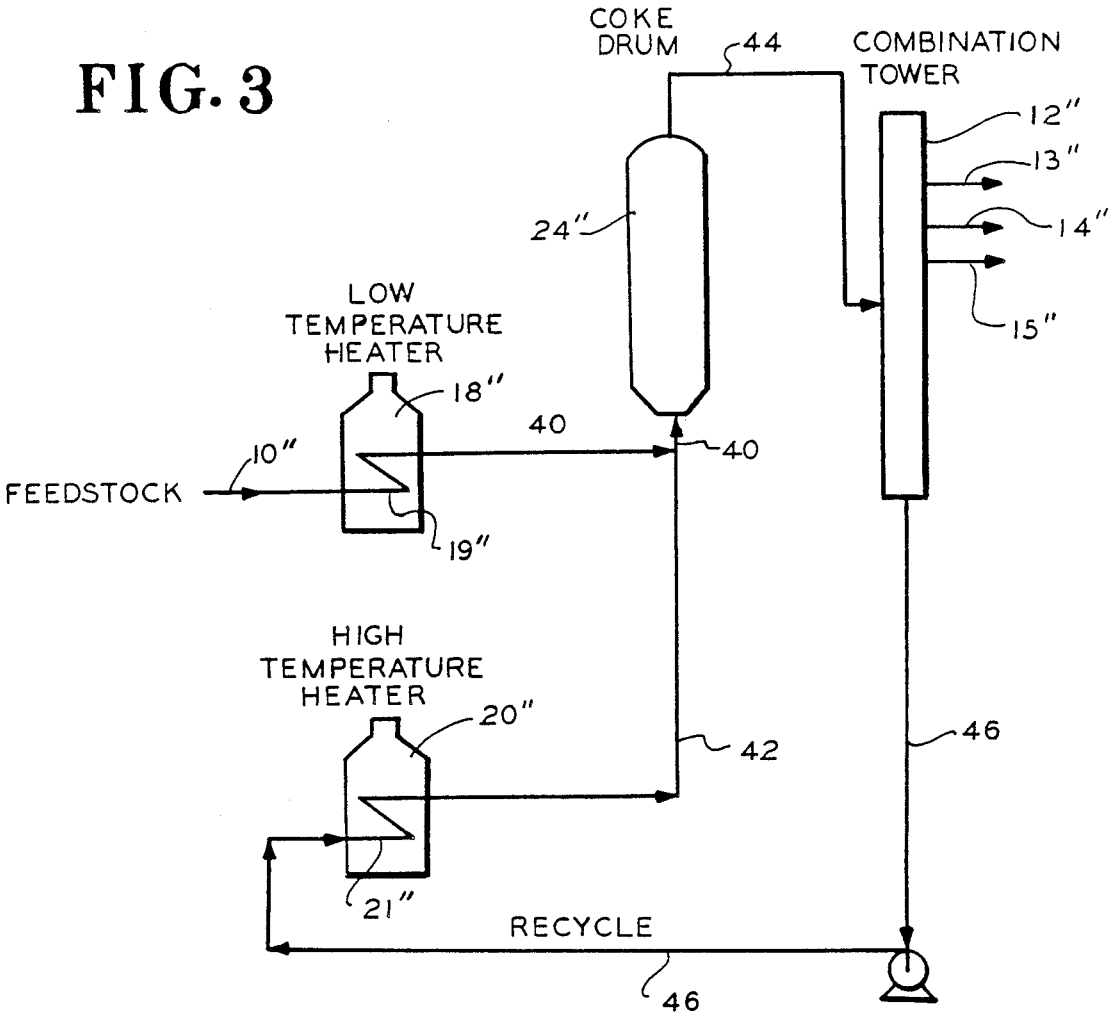
FIG. 3 is a schematic of third embodiment of a delayed coking process in accordance with the present invention.

Another embodiment in accordance with the present invention is depicted in FIG. 3. In this embodiment, a fresh feedstock which has not been subject to coking, is not sent to a coker combination tower before being introduced to a coker heater and a coke drum for coking. In the embodiment shown, a fresh feedstock is introduced into coil 19'' of coker heater 18'' through line 10". Prior to introduction of the fresh feedstock into the coker heater 18", the feedstock may be treated and/or processed by various means known in the art, e.g., as hereinabove described.

Coker heater 18" is operated at temperatures which are lower than those normally employed by a coking heater in a delayed coking process. Such temperatures generally do not exceed 900° F. and preferably do not exceed 850° F., as hereinabove described. Coker heater 18" is thus maintained at a temperature low enough so as to prevent the deposit of coke in coil 19". The feedstock, after being heated in coker heater 18", is withdrawn from coker heater 18" through line 40. The feed is then combined with a coker recycle stream introduced into line 40' through line 42. The recycle stream is at a temperature which is higher than normal coking temperatures. The recycle stream thereby serves to heat the feedstock to a desired coking temperature. The combined stream of feedstock and the recycle stream is then introduced through line 40 into coke drum 24". In coke drum 24", coking of the combined stream takes place at a temperature of from about 415° C. to about 510° C., and a pressure of from about 2 $kg/cm^2G$ to about 10 $kg/cm^2G$, whereby coke is formed from the combined stream within coke drum 24". Overhead vapors from coke drum 24" are then withdrawn through line 44.

The overhead vapors are passed through line 44 into coker combination tower 12". The coker combination tower 12" is operated under conditions which are known to one of ordinary skill in the art. The overhead vapors are fractionated into various usable products.

Coker naphtha and gases are recovered through line 13", a light coker gas oil is recovered through line 14", and a heavy coker gas oil is recovered through line 15". Alternatively, all or a portion of the heavy coker gas oil may be withdrawn as part of a bottoms fraction. A bottoms fraction is withdrawn through line 46, and becomes a coker recycle stream to coke drum 24". The bottoms fraction, or recycle stream, passes through line 46 and enters coil 21" of coker heater 20". Coker heater 20" is operated at a temperature to provide a heated recycle which provides a combined feed at coking temperatures.

After being heated in coker heater 20", the bottoms fraction, or recycle stream, is withdrawn from coker heater 20" through line 42. The recycle stream then contacts the fresh feedstock in line 40. The recycle stream serves to heat the fresh feedstock so as to provide a combined feed of the fresh feedstock and coker recycle at coking temperatures. A heat exchange thus occurs between the fresh feedstock and the recycle stream in line 40. The result is the formation of a combined stream of fresh feedstock and recycle in line 40, said combined stream being at a desired coking temperature. The combined stream is then fed to coke drum 24" as described above.

Alternatively, the fresh feedstock in line 40 and the recycle stream in line 42 may be fed separately to coke drum 24", thereby being admixed in coke drum 24", said mixture attaining a desired coking temperature in coke drum 24".

Advantages of the present invention include the ability to heat a fresh feed to a desired coking temperature, while reducing the tendency to deposit coke in the coils of the coking heater. This is accomplished by a partial heating of the fresh feed or a high-boiling fraction of a fresh feed, in a coker heater, whereby the feedstock or high-boiling fraction is heated to temperatures lower than those normally employed by a coking heater in a delayed coking process. This reduces the deposit of coke in the coils of the heater, thus preventing periodic shutdowns of the coking apparatus so that the coking heater may be cleaned or replaced. The final heating of the fresh feedstock to a desired coking temperature is accomplished by contact of the fresh feed in a feed line to a coke drum, or within the coke drum, by a heated recycle stream essentially free of easily cokable components. In this manner, a fresh feedstock or high-boiling fraction, may be heated to a desired coking temperature without the deposit of coke in the coils of the coker heater.

It is to be understood, however, that the scope of the present invention is not to be limited to the specific embodiments described above. The invention may be practiced other than as particularly described and still be within the scope of the accompanying claims.

What is claimed is:

1. A delayed coking process, comprising:
introducing a coker feed to a combination tower;
fractionating said coker feed in said combination tower to provide a first cokable portion containing easily cokable components and a second cokable portion essentially free of easily cokable components;
heating said first cokable portion to a temperature below 900° F.;
heating said second cokable portion to a temperature at which a combination of said first cokable portion and said second cokable portion provides a combined feed which is at coking temperatures of from about 780° F. to about 950° F.; and
coking said combined feed at coking temperatures of from about 780° F. to about 950° F.

2. A delayed coking process, comprising:
heating a first cokable stream comprising a fresh feed to a temperature below 900° F.;
heating a second cokable stream comprising at least a portion of recycled coker vapor in the absence of a fresh feed to a temperature at which a combination of said first stream and said second stream provides a combined feed which is at coking temperatures of from about 780° F. to about 950° F.; and
coking said combined feed at coking temperatures of from about 780° F. to about 950° F.

3. The process of claim 2 wherein said first cokable stream is heated to a temperature less than 850° F.

4. The process of claim 2 wherein said first cokable stream includes components which boil above a temperature of about 900° F.

5. The process of claim 2 wherein said fresh feed is selected from the group consisting of coal liquefaction products, pyrolysis fuel oils, lube oil extracts, hydrodesulfurized lube oil extracts, catalytic cracker decant oils, coal tar, coal tar pitch, and thermally cracked tars.

6. The process of claim 2 wherein said recycled coker vapor is separated into a light fraction comprised of material boiling below a temperature in the range of from about 500° F. to about 650° F. and into a heavy fraction comprised of materials boiling above a temperature in the range of about 500° F. to about 650° F., said light fraction being combined with said fresh feed to produce said first stream, and said heavy fraction becoming said second stream.

7. The process of claim 1 wherein said first portion is heated to a temperature which does not exceed 850° F.

8. The process of claim 1 wherein said first portion includes components which boil above a temperature of about 900° F.

9. The process of claim 2 wherein said fresh feed is selected from the group consisting of coal liquefaction products, pyrolysis fuel oils, lube oil extracts, hydrodesulfurized lube oil extracts, catalytic cracker decant oils, coal tar, coal tar pitch, and thermally cracked tars.

10. The process of claim 1 wherein said second portion is essentially free of components boiling below a temperature of about 1,000° F.

11. The process of claim 10 wherein said second portion is essentially free of components boiling below a temperature of about 900° F.

* * * * *